US007911420B2

(12) United States Patent
Choi

(10) Patent No.: US 7,911,420 B2
(45) Date of Patent: Mar. 22, 2011

(54) PLASMA DISPLAY APPARATUS AND METHOD OF DRIVING THE SAME

(75) Inventor: Jeongpil Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 720 days.

(21) Appl. No.: 11/947,264

(22) Filed: Nov. 29, 2007

(65) Prior Publication Data

US 2008/0122752 A1 May 29, 2008

(30) Foreign Application Priority Data

Nov. 29, 2006 (KR) ..... 10-2006-0119393

(51) Int. Cl.
*G09G 3/28* (2006.01)

(52) U.S. Cl. ..... 345/67; 345/60; 345/70; 315/169.4

(58) Field of Classification Search ..... 345/60–70, 345/204; 315/169.4
See application file for complete search history.

(56) References Cited

U.S. PATENT DOCUMENTS 5,155,414 A * 10/1992 Sano ..... 315/169.4
6,710,755 B1 3/2004 Shiozaki et al. ..... 345/60
7,224,329 B1 * 5/2007 Onozawa et al. ..... 345/60
2005/0237278 A1 * 10/2005 Choi ..... 345/67
2005/0280024 A1 * 12/2005 Kim et al. ..... 257/146
2006/0038806 A1 * 2/2006 Jeong ..... 345/204

FOREIGN PATENT DOCUMENTS

EP 0 810 577 B1 12/1997
EP 1 657 699 A1 5/2006
KR 10-2006-0007688 A 1/2006
KR 10-2006-0016568 A 2/2006
KR 10-0573163 B1 4/2006

OTHER PUBLICATIONS

European Search Report dated Oct. 20, 2008.

* cited by examiner

*Primary Examiner* — Amare Mengistu
*Assistant Examiner* — Premal Patel
(74) *Attorney, Agent, or Firm* — Ked & Associates, LLP

(57) ABSTRACT

A plasma display apparatus comprises a plasma display panel and a scan driver. The plasma display panel comprising a first scan electrode, a second scan electrode, and a sustain electrode. The scan driver supplies the first scan electrode with a first scan signal, supplies the first scan electrode and the second electrode with a first signal for emitting light, and then supplies the second scan electrode with a second scan signal that falls down from a scan reference voltage, and supplies the first scan electrode with a voltage that is different from the scan reference voltage while the second scan signal is supplied.

20 Claims, 8 Drawing Sheets

PLASMA DISPLAY APPARATUS AND METHOD OF DRIVING THE SAME

This non-provisional application claims priority under 35 U.S.C. §119(a) on Patent Application No. 10-2006-0119393 filed in Republic of Korea on Nov. 29, 2006 the entire contents of which are hereby incorporated by reference

BACKGROUND

1. Field

This document relates to a display apparatus, and more specifically, to a plasma display apparatus and a method of driving the same.

2. Related Art

A plasma display panel ("PDP") apparatus comprises a PDP and a driver for driving the PDP.

The PDP comprises a front panel and a rear panel. Barrier ribs are formed on the rear panel to define unit discharge cells. An inert gas that contains a main discharge gas, such as Ne, He, or a mixture of Ne and He, and Xe is injected in each of the unit discharge cells.

When a high frequency voltage is applied to the unit discharge cells to create an electric discharge, vacuum ultra violet rays that are generated from the inert gas excite a phosphor formed between the barrier ribs. At this time, the excited phosphor emits light.

The PDP comprises a scan electrode Y, a sustain electrode Z, and a data electrode X. The driver is connected to the electrodes to apply voltages to the electrodes.

Meanwhile, driving efficiency can be lowered due to various factors when the voltages are applied from the driver to the electrodes. Accordingly, studies have been in progress to optimize driving conditions of the PDP apparatus.

SUMMARY

In one aspect, a plasma display apparatus comprises a plasma display panel comprising a first scan electrode, a second scan electrode, and a sustain electrode and a scan driver, wherein the scan driver supplies the first scan electrode with a first scan signal, supplies the first scan electrode and the second electrode with a first signal for emitting light, and then supplies the second scan electrode with a second scan signal that falls down from a scan reference voltage, and supplies the first scan electrode with a voltage that is different from the scan reference voltage while the second scan signal is supplied.

The sustain driver may supply the sustain electrode with a second signal for emitting light in the sustain electrode after the supply of the first signal and before the supply of the second scan signal.

The scan driver and the sustain driver may alternately supply the first signal and the second signal more than once and less than three times.

The plasma display apparatus may further comprise a sustain driver, and the sustain driver may supply the sustain electrode with a ground voltage while the scan driver supplies the first signal.

The plasma display apparatus may further comprise a sustain driver, and the sustain driver may supply the sustain electrode with a sustian signal after the supply of a sustain signal to the first scan electrode and the second scan electrode.

The scan driver may supply the second scan electrode with a signal that gradually falls down to a first voltage after the supply of the first signal.

The scan driver may supply the second scan electrode with a set-down signal that gradually falls down to a second voltage that is higher than the first voltage before supplying the first scan signal.

The voltage that may different from the scan reference voltage is a ground voltage.

The voltage that is different from the scan reference voltage may be a negative voltage.

When the negative voltage is supplied, a voltage that is lower than the sustain voltage may be supplied to the sustain electrode.

In another aspect, a method of a plasma display apparatus comprising a first scan electrode, a second scan electrode, and a sustain electrode, comprises supplying the first scan electrode with a first scan signal, supplying the second scan electrode with a second scan signal that falls down from a scan reference voltage after the supply of the first scan electrode and the second scan electrode with a first signal for emitting light and supplying the first scan electrode with a voltage that is different from the scan reference voltage while the second scan signal is supplied.

A second signal for emitting light in the sustain electrode may be supplied to the sustain electrode after the supply of the first signal and before the supply of the second scan signal.

The first signal and the second signal may be alternately supplied more than once and less than three times.

A ground voltage may be supplied to the sustain electrode while the first signal is supplied.

After the second scan signal was supplied, a sustain signal may be supplied to the first scan electrode and the second scan electrode, and a sustain signal may be supplied to the sustain electrode.

A signal that gradually falls down to a first voltage may be supplied to the second scan electrode after the first signal was supplied.

A set-down signal that gradually falls down to a second voltage that is higher than the first voltage may be supplied to the first scan electrode and the second scan electrode before the first scan signal is supplied.

The voltage that is different from the scan reference voltage may be a ground voltage.

The voltage that is different from the scan reference voltage may be a negative voltage.

When the negative voltage is supplied, a voltage that is lower than the sustain voltage may be supplied to the sustain electrode.

BRIEF DESCRIPTION OF THE DRAWINGS

The implementation of this document will be described in detail with reference to the following drawings in which like numerals refer to like elements.

DETAILED DESCRIPTION

Hereinafter, an implementation of this document will be described in detail with reference to the attached drawings.

Figure 1:
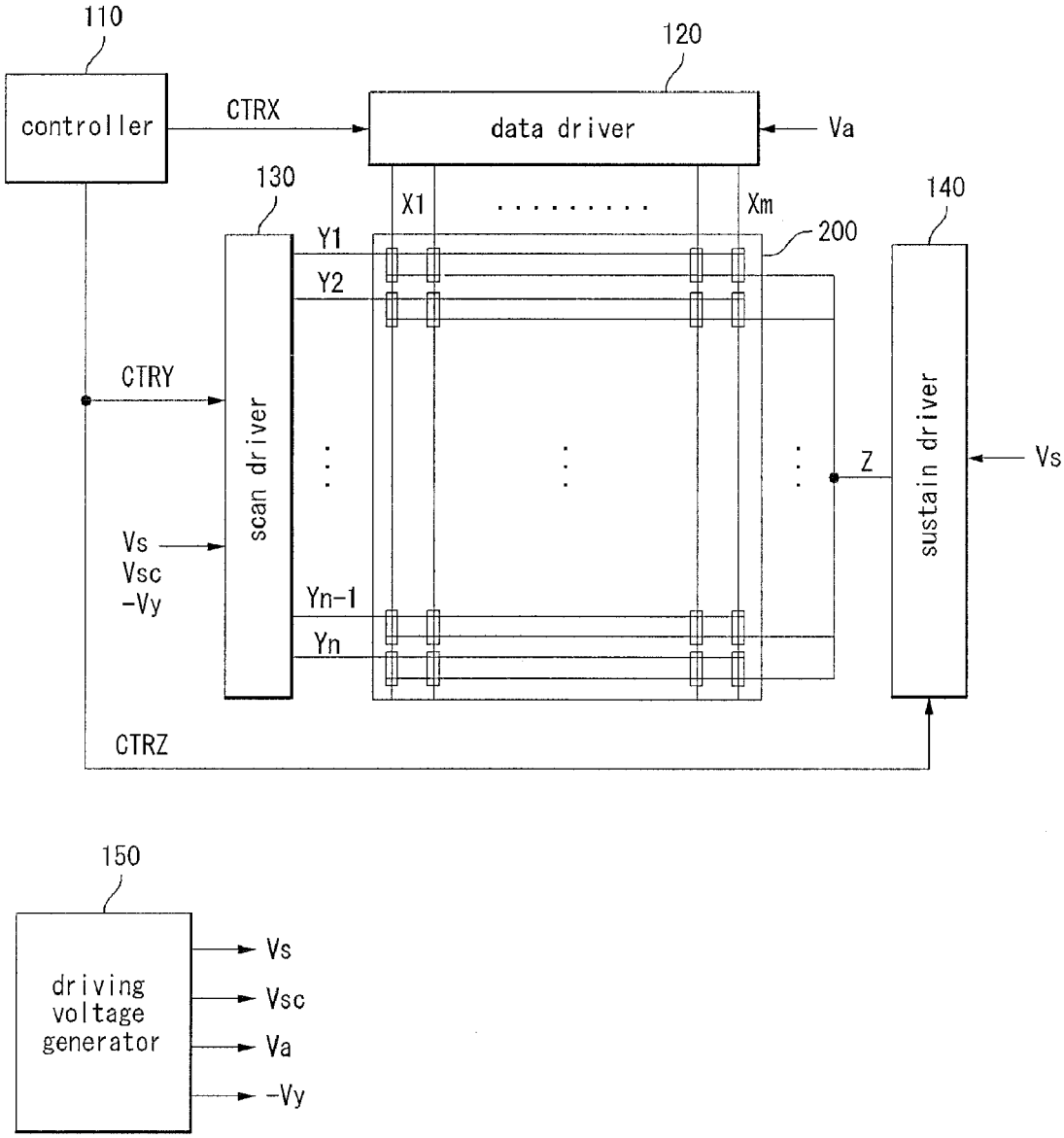
FIG. 1 is a view illustrating a PDP apparatus according to an exemplary embodiment of the present invention.

Referring to FIG. 1, a PDP apparatus comprise a PDP 200, drivers, for example, a data driver 120, a scan driver 130, and a sustain driver 140, for driving electrodes disposed on the PDP 200, a controller for controlling the drivers, and a driving voltage generator 150 for generating driving voltages required for the drivers.

The driver 120 supplies data to data electrodes X1 to Xm, the scan driver 130 drives scan electrodes Y1 to Yn, and the sustain driver 140 drives sustain electrodes Z.

Figure 2:
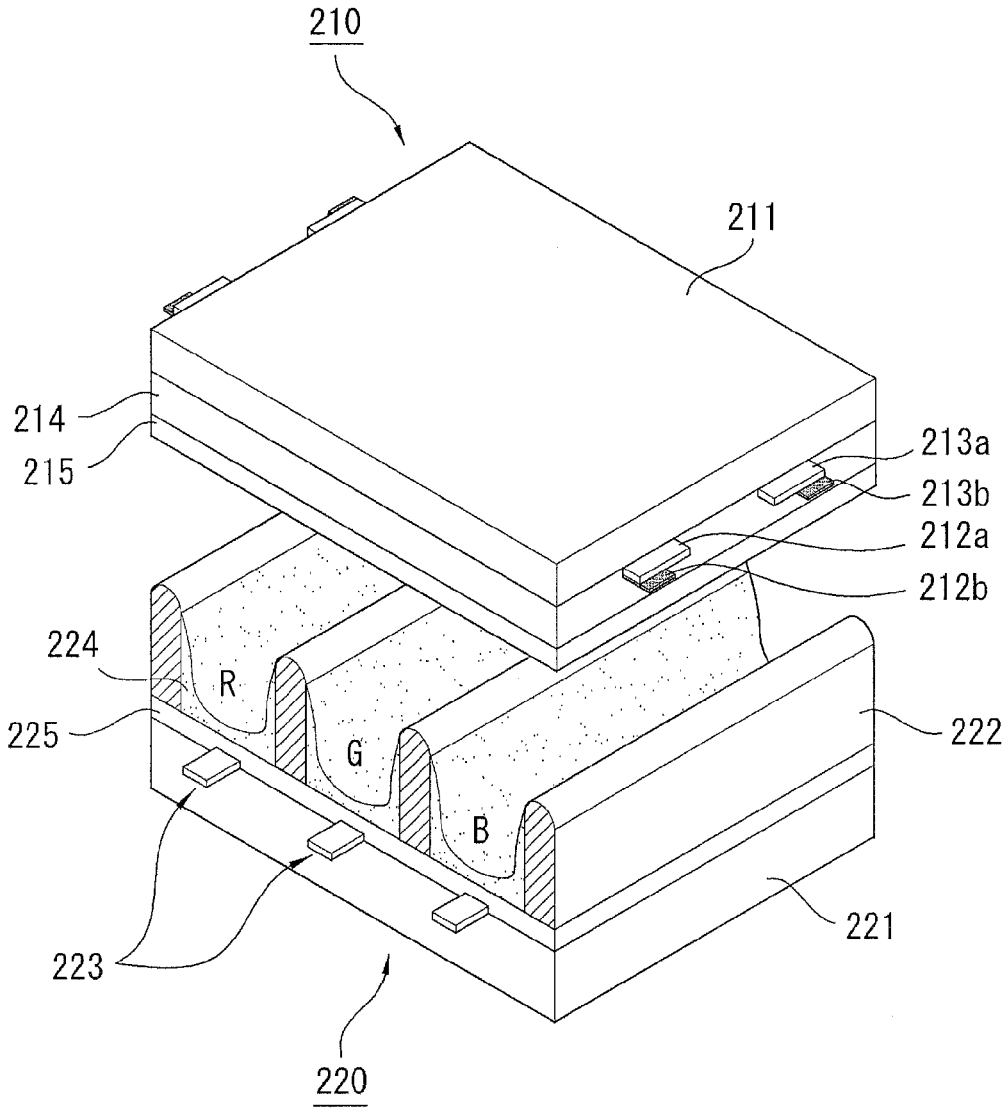
FIG. 2 is a view illustrating a PDP according to an exemplary embodiment of the present invention.

Referring to FIG. 2, the PDP 200 comprises a front panel 210 and a rear panel 220.

The front panel 210 comprises a front substrate 211, and a scan electrode 212 and a sustain electrode 213 are disposed on the front substrate 211. The rear panel 220 comprises a rear substrate 221, and a data electrode 223 that crosses the scan electrode 212 and the sustain electrode 221 is disposed on the rear substrate 221.

The scan electrode 212, Y may comprise a transparent electrode 212*a* formed of a transparent ITO material and a bus electrode 212*b* formed of a metal material. The sustain electrode 213 may comprise a transparent electrode 213*a* formed of a transparent ITO material and a bus electrode 213*b* formed of a metal material. The scan electrode 212 and the sustain electrode 213 may comprise the bus electrode 212*b* alone and the bus electrode 213*b* alone, respectively.

An upper dielectric layer 214 restricts discharge currents of the scan electrode 212 and the sustain electrode 213 and insulates the electrodes from each other. A protection layer 215 is disposed on the upper dielectric layer 204 by coating an MgO layer on the upper dielectric layer 204.

A lower dielectric layer 225 covers the data electrode 223 to insulate one data electrode from another. A barrier rib 222 is formed in a stripe type or well type to define a discharge cell. A phosphor, for example, R phosphor, G phosphor, or G phosphor, is coated for emitting visible light between two barrier ribs 222 that are adjacent to each other.

Figure 3:
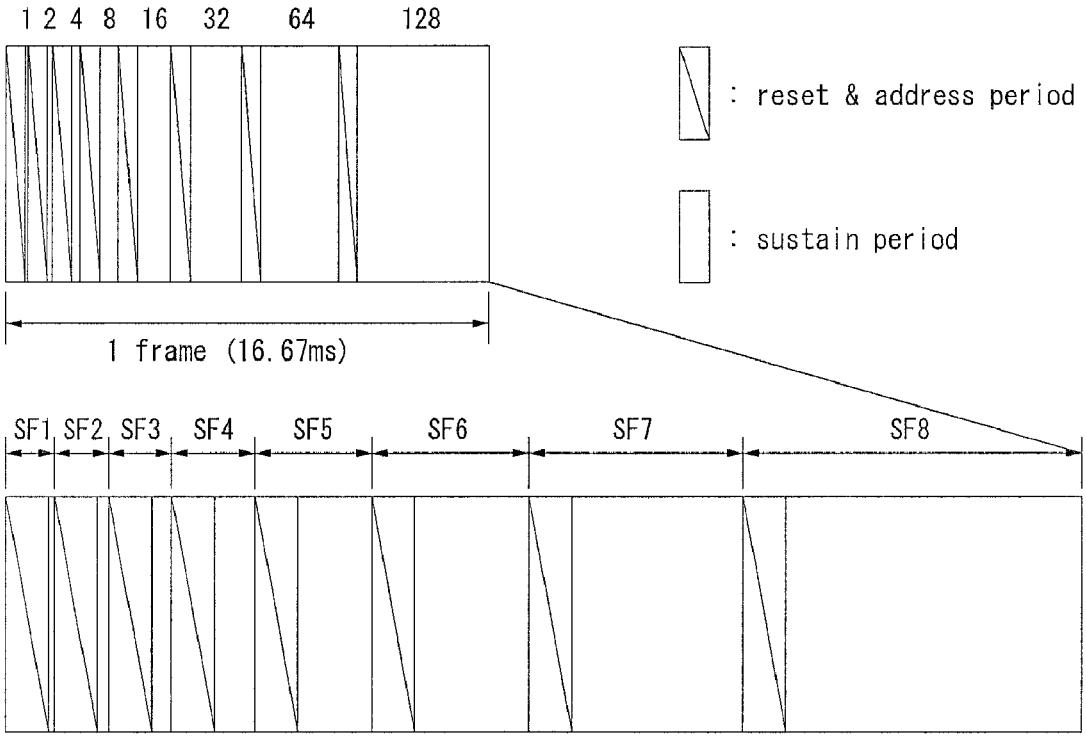
FIG. 3 is a view illustrating a method of driving a PDP apparatus according to an exemplary embodiment of the present invention.

In a PDP apparatus according to an exemplary embodiment of the present invention, one frame is divided into a plurality of sub-frames to drive the PDP apparatus, as shown in FIG. 3. Each subfield comprises a reset period for initializing all cells, an address period for selecting a cell to be discharged, and a sustain period for realizing a gray level according to the number of discharges.

For example, when an image is displayed with 256 gray levels, a frame period (e.g. 16.67 ms) that corresponds to 1/60 sec is divided into a plurality of sub-fields, for example, eight sub-fields SF1 to SF8. As described above, each of the eight sub-fields SF1 to SF8 comprises a reset period RP, an address period AP, and a sustain period SP. The reset period RP and the address period AP are the same for each sub-field, while the sustain period SP and the number of sustain signals assigned during the sustain period SP may vary for each sub-field. As an example, the sub-field is increased in the ratio of 2n (n=0, 1, 2, 3, 4, 5, 6, and 7) to display gray levels.

The scan driver 130 supplies scan electrodes Y1 to Yn with a reset signal during a reset period under control of the controller 110 to initialize the state of wall charges in all the discharge cells formed during the previous sub-field. The reset signal comprises a gradually rising set-up signal and a gradually falling set-down signal.

The scan driver 130 supplies the scan electrodes Y1 to Yn with a scan signal (Scan) that falls down up to a scan voltage −Vs during an address period under control of the controller 110.

The scan driver 130 supplies the scan electrodes Y1 to Yn with a sustain signal that rises up to a sustain voltage Vs during a sustain period under control of the controller 110.

A data signal is reverse-gamma corrected, error-diffused, and mapped to each sub-field by a reverse-gamma correction circuit (not shown), an error diffusion circuit (not shown), and a sub-field mapping circuit (not shown), respectively, and then the data signal is supplied to the data driver 120. The data driver 120 samples and latches the data signal in response to a timing control signal CTRX of the controller 110, and then supplies the sampled and latched data signal to the data electrodes X1 to Xm. A cell to be turned on/off, for example, in which a sustain discharge is generated during a sustain period, is selected depending on the data signal.

The sustain driver 140 supplies a bias voltage to the sustain electrode Z during at least one of the set-down period and address period. In addition, the sustain driver 140 supplies the sustain electrode Z with a sustain signal that rises up to a sustain voltage Vs during the sustain period.

The controller 110 receives horizontal/vertical synchronization signals and a clock signal, generates timing control signals CRTX, CTRY, and CTRZ for controlling the operation timing and synchronization of each driver 120, 130, and 140 during the reset period, address period, and sustain period, and supplies the timing control signals CTRX, CTRY, and CTRZ to a corresponding one of the drivers 120, 130, and 140 in order to control the drivers 120, 130, and 140.

The data control signal CTRX includes a sampling clock signal for sampling data, a latch control signal, and a switch control signal for controlling on/off time of a sustain driving circuit and a driving switching element. The scan control signal CTRY comprises a switch control signal for controlling on/off time of a sustain driving circuit and a driving switching element in the scan driver 130, and the sustain control signal CTRZ comprises a switch control signal for controlling on/off time of a sustain driving circuit and a driving switching element in the sustain driver 140.

The driving voltage generator 150 generates driving voltages such as a set-up voltage Vsetup, a scan reference voltage Vsc, a scan voltage −Vy, a sustain voltage Vs, and a data voltage Va. The driving voltages may vary depending on the composition of the discharge gas or structure of the discharge cell.

Figure 4A:
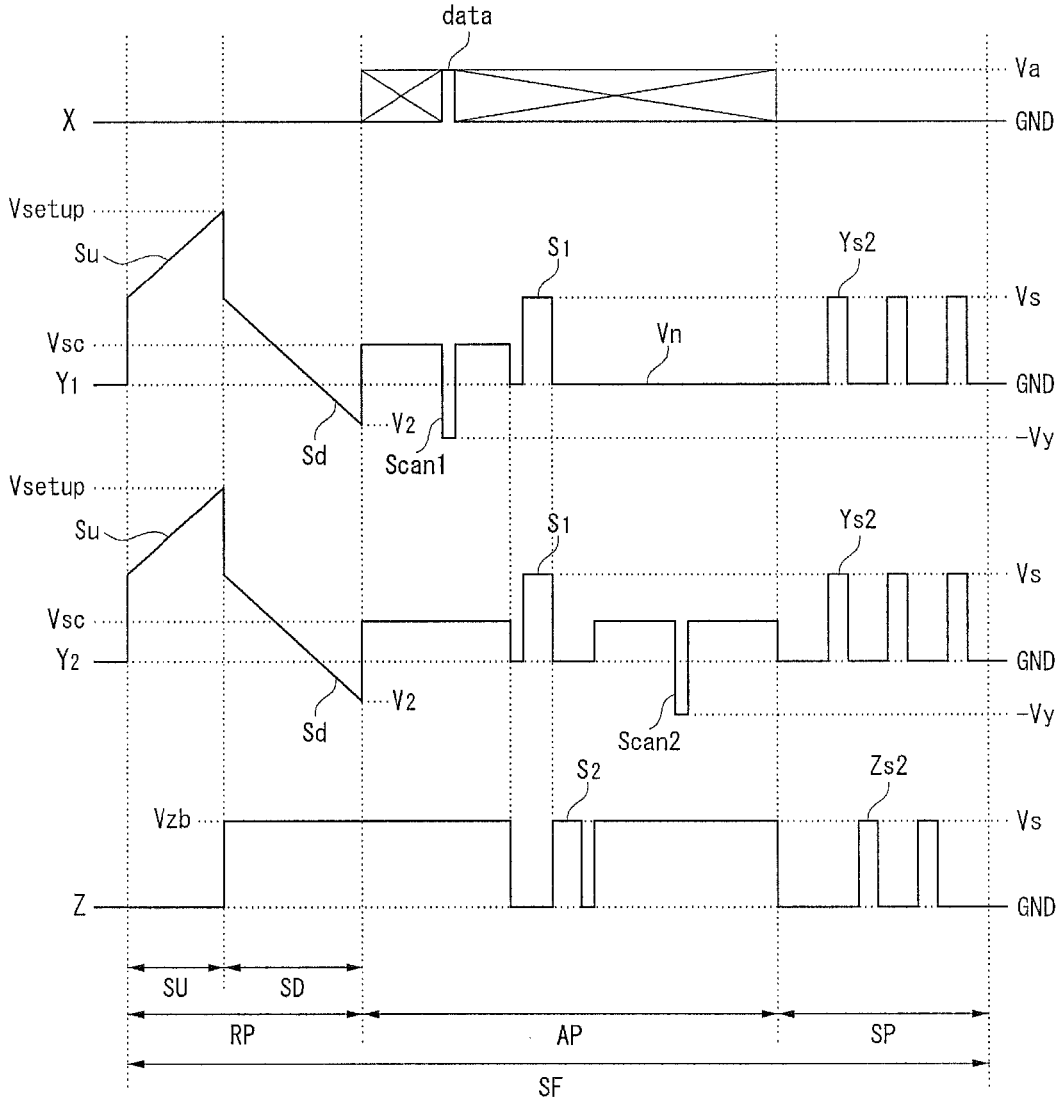
FIGS. 4*a* and 4*b* are first waveforms of a PDP apparatus according to a first exemplary embodiment of the present invention.

Referring to FIG. 4*a*, one sub-field SF comprises a reset period RP, an address period AP, and a sustain period SP.

During a set-up period SU of the reset period RP, a set-up signal Su that rises up to the set-up voltage Vsetup is supplied to the first scan electrode Y1 and the second scan electrode Y2 by the scan driver 130 shown in FIG. 1. The first scan electrode Y1 and the second scan electrode Y2 may be located adjacent to each other, or not. A dark discharge is caused by the set-up signal Su in the entire discharge cells.

During a set-down period SD of the reset period RP, a set-down signal Sd that gradually falls down to a second voltage V2 is simultaneously supplied to the first scan electrode Y1 and the second scan electrode Y2 by the scan driver 130 shown in FIG. 1. The set-down signal Sd causes an erase discharge in the discharge cell to remove wall discharges that are excessively generated by the set-up discharge and make the wall discharges distributed uniformly.

The scan driver 130 supplies a first scan signal Scan1 to the first scan electrode Y1, supplies the first scan electrode Y1 and the second scan electrode Y2 with a first signal S1 for emitting light, and then supplies a scan signal Scan2 to the second scan electrode Y2. The first signal S1 rises from a ground voltage to the sustain voltage Vs.

When a data signal (data) is supplied to the data electrode X in synchronization with the first scan signal Scan1, address discharges occur in the discharge cells that correspond to the first scan electrode Y1. Accordingly, when the first signal S1 that rises up to the sustain voltage Vs is supplied, light is emitted in the discharge cells where the address discharges are generated.

After the first signal S1 was supplied, the scan driver 130 supplies the first scan electrode Y1 and the second scan electrode Y2 with a sustain signal Ys2 that rises up to the sustain voltage V2 during the sustain period SP.

The scan driver 130 supplies the scan reference voltage Vsc to the second scan electrode Y2 while the first scan signal Scan1 is supplied to the first scan electrode Y1.

The sustain driver 140 supplies the bias voltage Vzb to the sustain electrode Z while the first scan signal Scan1 is supplied to the first scan electrode Y1. The bias voltage Vzb decreases the number of discharges that occur between the first scan electrode Y1 and the sustain electrode Z during the address period AP.

The sustain driver 140 may supply the sustain electrode Z with the second signal S2 after the scan driver 130 supplies the first signal S1 with the first scan electrode Y1 and before the second scan signal Scan2 is supplied to the second scan electrode Y2. Accordingly, the discharge cells that correspond to the first scan electrode Y1 emits light again.

Figure 4B:
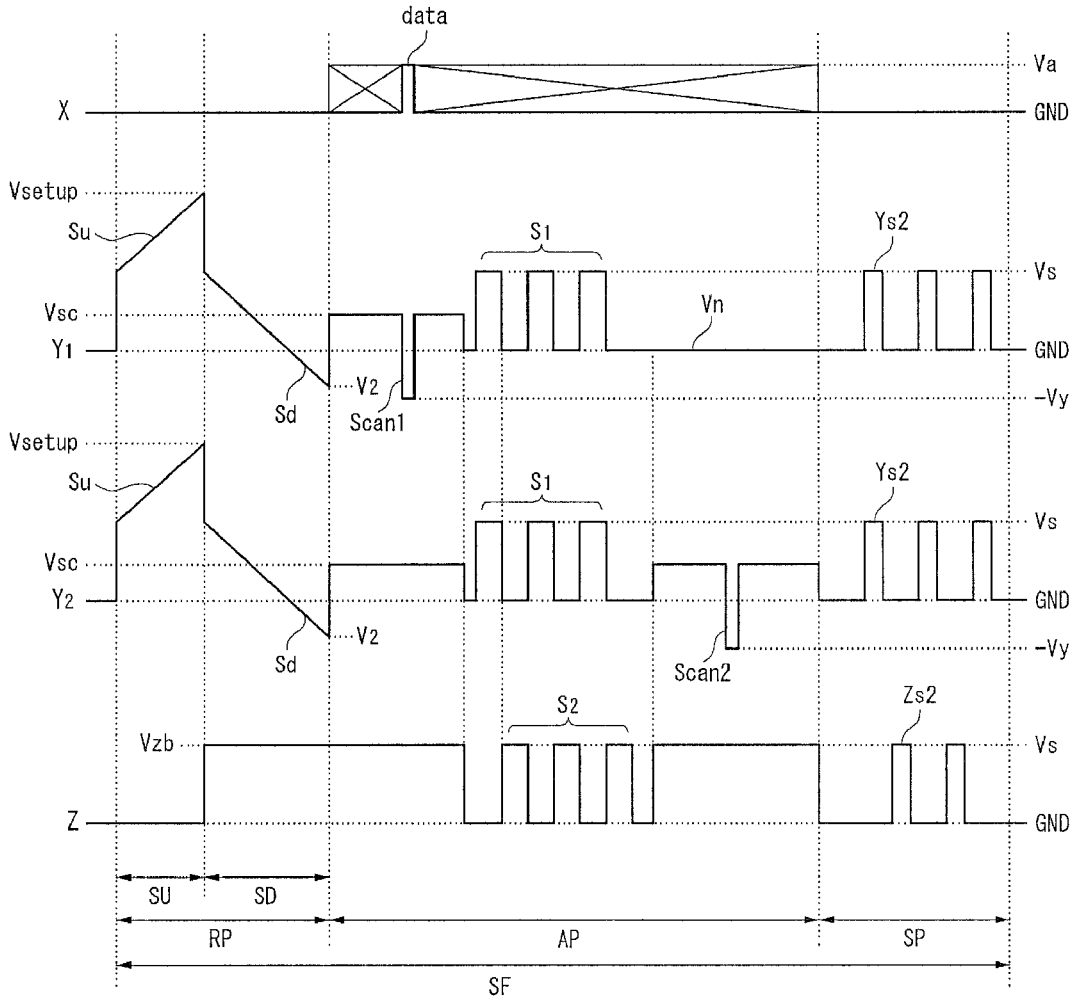

Referring to FIG. 4*b*, the first signal S1 and the second signal S2 may be alternately supplied more than one time and less than three times to the first and second scan electrodes Y1 and Y2 and the sustain electrode Z by the scan driver 130 and the sustain driver 140.

As shown in FIGS. 4*a* and 4*b*, the scan driver 130 supplies the second scan signal Scan2 to the second scan electrode Y2 after having supplied the first signal S1 to the first scan electrode Y1 and second scan electrode Y2. The scan driver 130 may supply the first scan electrode Y1 with some voltage Vn that is different from the scan reference voltage Vsc, while the second scan signal Scan2 is supplied to the second scan electrode Y2. The voltage Vn may be a ground voltage.

The data driver 120 supplies the data electrode X with a data signal (data) that synchronizes with the second scan signal Scan2, while the second scan signal Scan2 is supplied to the second scan electrode Y2. Accordingly, address discharges occur in the discharge cells that correspond to the second scan electrode Scan2.

The sustain driver 140 supplies the bias voltage Vzb to the sustain electrode Z while the second scan signal Scan2 is supplied. The bias voltage Vzb may be substantially identical to the sustain voltage.

After the address period AP, the sustain signal Ys2 and a sustain signal Zs2 that rise up to the sustain voltage Vs are alternately supplied to the first and second scan electrodes Y1 and Y2, and the sustain electrode Z by the scan driver 130 and the sustain driver 140.

When the first scan signal Scan1 is supplied to the first scan electrode Y1 before the second scan signal Scan2 is supplied to the second scan electrode Y2, the loss of wall charges and priming particles after the supplying of the first scan signal Scan1 further increases in the first scan electrode Y1 than in the second scan electrode Y2. Therefore, if the first signal S1 is supplied between when the first scan signal Scan1 is supplied and when the second scan signal Scan2 is supplied, the loss of wall charges and priming particles in the first scan electrode Y1 could be compensated. Accordingly, the sustain discharges can occur stably in the discharge cells supplied with the first and second scan signals Scan1 and Scan2.

When the first scan signal Scan1 is supplied to the first scan electrode Y1 before the second scan signal Scan2 is supplied to the second scan electrode Y2, the loss of wall charges caused during the reset period RP before the supplying of the first scan signal Scan2 further increases in the second scan electrode Y2 than in the first scan electrode Y1. As such, the first signal S1 is supplied to the second scan electrode Y2 before the second scan signal Scan2 is supplied, and therefore, the loss of wall charges caused in the second scan electrode Y2 can be compensated.

Figure 5:
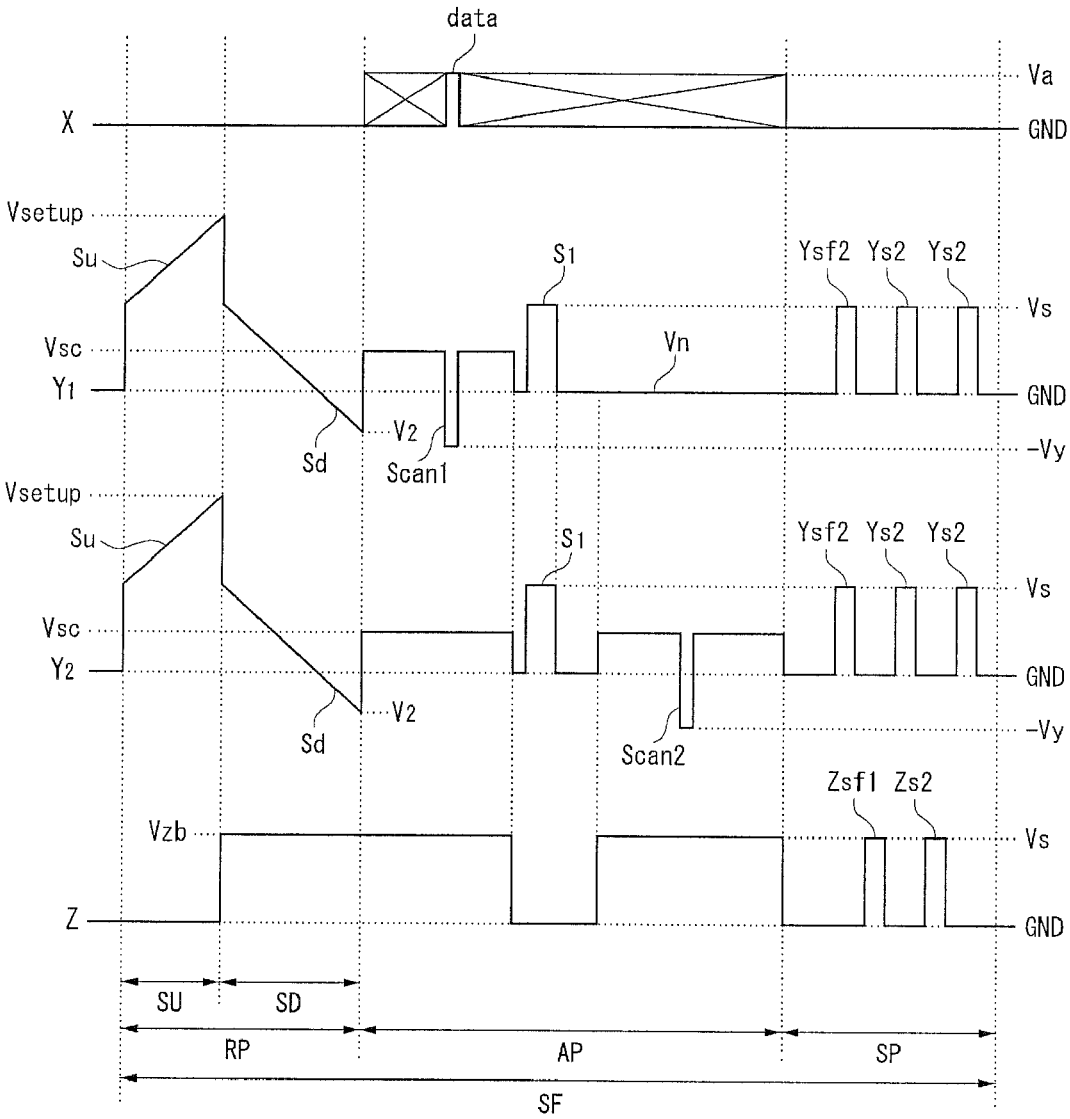
FIG. 5 is a second waveform of a PDP apparatus according to a second exemplary embodiment of the present invention.

Referring to FIG. 5, when the scan driver 130 supplies the first signal S1 to the first scan electrode Y1 and the second scan electrode Y2 during the address period AP, the sustain driver 140 may supply the sustain electrode Z with a ground voltage GND. The driving waveforms of signals during the reset period RP in FIG. 5 are similar to those in FIGS. 4*a* and 4*b*, and therefore, their detailed descriptions will be omitted.

When the first scan signal Scan1 and data signal (data) are supplied, address discharges occur in the discharge cells that correspond to the first scan electrode Y1 but does not occur in the discharge cells that correspond to the second scan electrode Y2.

After the first scan signal Scan1 has been supplied to the first scan electrode Y1 and before the second scan signal Scan2 is supplied to the second scan electrode Y2, the first signal S1 is supplied to the first scan electrode Y1 and the second scan electrode Y2, and the second signal S2 is not supplied to the sustain electrode Z. Therefore, sustain discharges occur in only the discharge cells that correspond to the first scan electrode Y1 and caused the address discharges but not in the discharge cells that correspond to the second scan electrode Y2.

After the first signal S1 was supplied to the first scan electrode Y1 and the second scan electrode Y2, the second scan signal Scan2 is supplied to the second scan electrode Y2.

And then, sustain signals Ysf2 and Ys2, and Zsf1 and Zs2 are alternately supplied to the first and second scan electrodes Y1 and Y2, and the sustain electrode Z, respectively.

During the address period AP, the first signal S1 is supplied only to the first scan electrode Y1 and the second scan electrode Y2 and the sustain discharges occur only in the discharge cells that correspond to the first scan electrode Y1, and therefore, the sustain discharges do not occur in the discharge cells that correspond to the first scan electrode Y1 by the sustain signal Ysf2 that is firstly supplied to the first scan electrode Y1.

In addition, since sustain discharges did not occur in the discharge cells that correspond to the second scan electrode Y2, sustain discharges can be generated in the discharge cells that correspond to the second scan electrode Y2 by the first sustain signal Ysf2 which is applied to the second scan electrode Y2.

Accordingly, since a single sustain discharge occurs in the discharge cells corresponding to the first scan electrode Y1 and the second scan electrode Y2 for the address period and a part of the sustain period during which the first sustain signal Ysf2 is supplied, variations in brightness of the light emitting from the discharge cells that correspond to the first and second scan electrodes Y1 and Y2 do not occur.

Accordingly, the driving waveforms shown in FIG. 5 can compensate the loss of wall charges and priming particles as well as reduce the variations in brightness.

Figure 6:
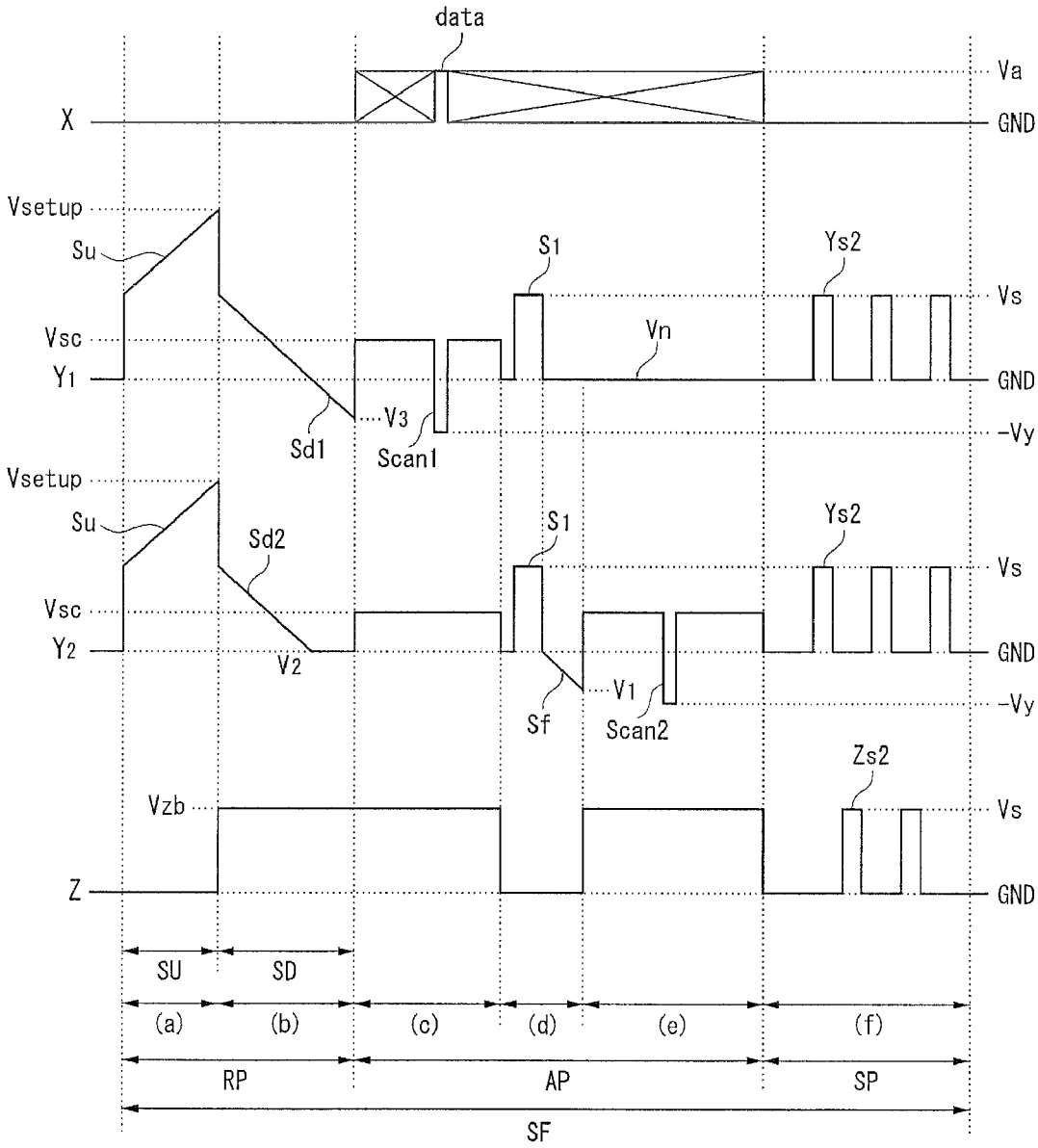
FIG. 6 is a third waveform of a PDP apparatus according to a third exemplary embodiment of the present invention.

The driving waveforms of signals during the set-up period SU in FIG. 6 are similar to those in FIGS. 4*a* and 4*b*, and therefore, their detailed descriptions will be omitted.

During a set-down period SD, the scan driver 130 supplies the first scan electrode Y1 with the first set-down signal Sd1 that falls down to the third voltage V3, and supplies the second scan electrode Y2 with the second set-down signal Sd2 that falls down to the second voltage V2 which is higher than the third voltage V2.

The scan driver 130 supplies the first scan electrode Y1 with the first scan signal Scan1, supplies the second scan electrode Scan2 with the scan reference voltage Vsc, and supplies the first signal S1 to the first scan electrode Y1 and the second scan electrode Y2.

After having supplied the first signal S1 to the second scan electrode Y2, the scan driver 130 supplies the second scan electrode Y2 with a signal Sf that gradually falls from the ground voltage to the first voltage V1 which is lower than the second voltage V2. At this time, the first voltage V1 may be substantially equal to the third voltage V3.

That is, the scan driver 130 supplies the second scan electrode Y2 with the second set-down signal Sd2 that gradually falls down to the second voltage V2 which is higher than the first voltage V1. The signal Sf that is supplied to the second scan electrode Y2 causes a weak erase discharge in the discharge cells corresponding to the second scan electrode Y2. The wall charges that are formed in the discharge cells corresponding to the second scan electrode Y2 are partially removed by the set-up discharges occurring during the set-up period SU.

In other words, the amount of wall charges to be removed by the first set-down signal Sd1 is larger than the amount of wall charges to be removed by the second set-down signal Sd2. Since the wall charges of the second scan electrode Y2 is removed by the signal Sf, the amount of wall charges formed in the first and second scan electrodes Y1 and Y2 may be controlled. That is, the amount of wall charges may be controlled in the first and second scan electrodes Y1 and Y2 by adjusting the levels of the first to the third voltages V1, V2, and V3.

During the address period, the ground voltage GND is supplied to the sustain electrode Z while the sustain voltage Vs is supplied to the first scan electrode Y1 and the second scan electrode Y2, and therefore, variations in brightness can be reduced as described above with reference to FIG. 5.

In addition to the compensation to loss of wall charges and decrease in brightness variation, the amount of wall charges can be adjusted to be suitable for the characteristics of various PDPs.

Figure 7:
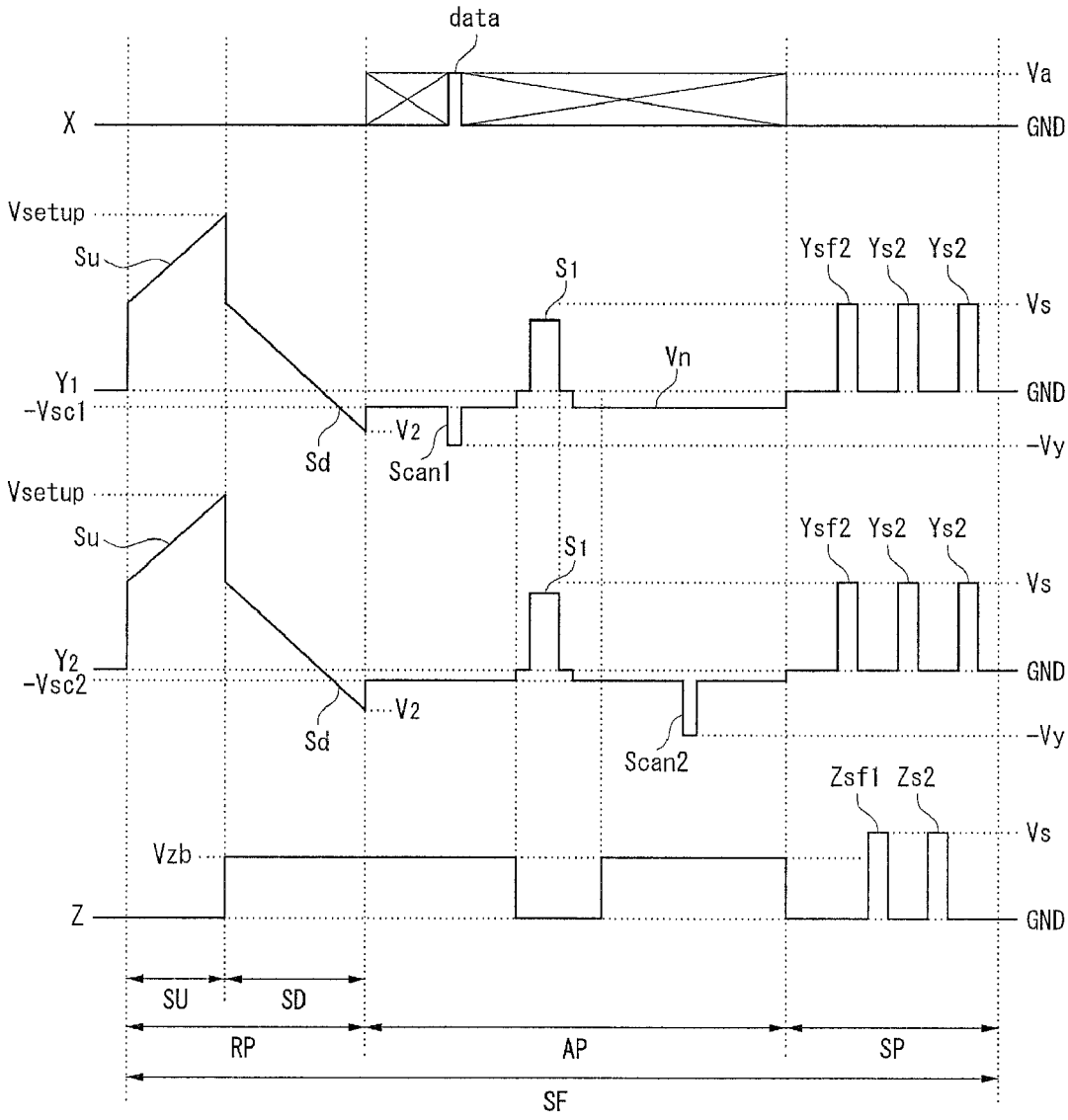
FIG. 7 is a fourth waveform of a PDP apparatus according to a fourth exemplary embodiment of the present invention.

The driving waveforms of signals during the set-up period SU in FIG. 7 are similar to those in FIGS. 4*a* and 4*b*, and therefore, their detailed descriptions will be omitted.

The driving waveforms of signals shown in FIG. 5 are different from those shown in FIG. 7, in that the first scan reference voltage −Vsc1 that is supplied to the first scan electrode Y1 after the first signal S1 and second signal S2 have been supplied to the first scan electrode Y1 and the second scan electrode Y2 is a negative voltage, and the level of the first scan reference voltage −Vsc is dissimilar to that of the second scan reference voltage −Vsc2. Accordingly, the driving waveforms of signals shown in FIG. 7 can adjust variations in address discharge of the discharge cells that correspond to the first and second scan electrodes Y1 and Y2, which can be caused when the scan signals have the different supplying order.

The bias voltage Vzb that is supplied to the sustain electrode Z when the first and second scan signals Scan1 and Scan2 are supplied may be lower than the sustain voltage Vs. When the bias voltage Vzb equal to the sustain voltage Vs is supplied after the supplying of the first signal S1 and the second signal S2, there can occur sustain discharges, and therefore, the contrast of the PDP can be deteriorated. Accordingly, it can be possible to prevent the deterioration of the contrast of the PDP by supplying the bias voltage Vzb that is lower than the sustain voltage Vs.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus comprising:

a plasma display panel comprising a first scan electrode, a second scan electrode, and a sustain electrode; and a scan driver, wherein the scan driver supplies the first scan electrode with a first scan signal, supplies the first scan electrode and the second electrode with a first signal for emitting light, and then supplies the second scan electrode with a second scan signal that falls down from a scan reference voltage, and supplies the first scan electrode with a voltage that is different from the scan reference voltage while the second scan signal is supplied.

2. The plasma display apparatus of claim 1, further comprising:

a sustain driver, wherein the sustain driver supplies the sustain electrode with a second signal for emitting light in the sustain electrode after the supply of the first signal and before the supply of the second scan signal.

3. The plasma display apparatus of claim 2, wherein the scan driver and the sustain driver alternately supply the first signal and the second signal more than once and less than three times.

4. The plasma display apparatus of claim 1, further comprising:

a sustain driver, wherein the sustain driver supplies the sustain electrode with a ground voltage while the scan driver supplies the first signal.

5. The plasma display apparatus of claim 1, further comprising:

a sustain driver, wherein the sustain driver supplies the sustain electrode with a sustian signal after the supply of a sustain signal to the first scan electrode and the second scan electrode.

6. The plasma display apparatus of claim 1, wherein the scan driver supplies the second scan electrode with a signal that gradually falls down to a first voltage after the supply of the first signal.

7. The plasma display apparatus of claim 6, wherein the scan driver supplies the second scan electrode with a set-down signal that gradually falls down to a second voltage that is higher than the first voltage before supplying the first scan signal.

8. The plasma display apparatus of claim 1, wherein the voltage that is different from the scan reference voltage is a ground voltage.

9. The plasma display apparatus of claim 1, wherein the voltage that is different from the scan reference voltage is a negative voltage.

10. The plasma display apparatus of claim 9, wherein when the negative voltage is supplied, a voltage that is lower than the sustain voltage is supplied to the sustain electrode.

11. A method of a plasma display apparatus comprising a first scan electrode, a second scan electrode, and a sustain electrode, the method comprising:

supplying the first scan electrode with a first scan signal;

supplying the second scan electrode with a second scan signal that falls down from a scan reference voltage after the supply of the first scan electrode and the second scan electrode with a first signal for emitting light; and supplying the first scan electrode with a voltage that is different from the scan reference voltage while the second scan signal is supplied.

12. The method of claim 11, wherein a second signal for emitting light in the sustain electrode is supplied to the sustain electrode after the supply of the first signal and before the supply of the second scan signal.

13. The method claim 12, wherein the first signal and the second signal are alternately supplied more than once and less than three times.

14. The method of claim 11, wherein a ground voltage is supplied to the sustain electrode while the first signal is supplied.

15. The method of claim 11, wherein after the second scan signal was supplied, a sustain signal is supplied to the first scan electrode and the second scan electrode, and a sustain signal is supplied to the sustain electrode.

16. The method of claim 11, wherein a signal that gradually falls down to a first voltage is supplied to the second scan electrode after the first signal was supplied.

17. The method of claim 16, wherein a set-down signal that gradually falls down to a second voltage that is higher than the first voltage is supplied to the first scan electrode and the second scan electrode before the first scan signal is supplied.

18. The method of claim 11, wherein the voltage that is different from the scan reference voltage is a ground voltage.

19. The method of claim 11, wherein the voltage that is different from the scan reference voltage is a negative voltage.

20. The method of claim 19, wherein when the negative voltage is supplied, a voltage that is lower than the sustain voltage is supplied to the sustain electrode.

* * * * *